US005823860A

United States Patent [19]

Lynn et al.

[11] Patent Number: 5,823,860

[45] Date of Patent: Oct. 20, 1998

[54] BLASTING MEDIA CONTAINMENT SYSTEM

[75] Inventors: William Randall Lynn, Dover; Elliott Henry Felker, Madbury, both of N.H.

[73] Assignee: Integrated Foam Technologies, Inc., Dover, N.H.

[21] Appl. No.: 558,014

[22] Filed: Nov. 13, 1995

[51] Int. Cl.[6] ..... B24C 1/00

[52] U.S. Cl. ..... 451/89; 451/87; 451/453; 451/456

[58] Field of Search ..... 451/87, 89, 451, 451/453, 456, 439

[56] References Cited

U.S. PATENT DOCUMENTS

| | | | |
|---|---|---|---|
| 3,863,392 | 2/1975 | Haker | 451/453 |
| 4,787,179 | 11/1988 | Lewis | 451/87 |
| 4,852,307 | 8/1989 | Goudeau | 451/87 |
| 5,267,417 | 12/1993 | Rose | 451/89 |
| 5,431,593 | 7/1995 | Puschner | 451/89 |
| 5,460,564 | 10/1995 | Bowes et al. | 451/89 |

*Primary Examiner*—Eileen P. Morgan
*Attorney, Agent, or Firm*—Davis and Bujold

[57] ABSTRACT

A containment system for containing media and contaminants within an area adjacent a surface to be treated, comprising a barrier located proximate the surface and an elongate flexible member defining a perimeter of the area. An access port is provided in the barrier to allow application of a media to the surface, and an exhaust device is provided to create a negative pressure within the contaminant area and remove the media and/or contaminants from the area.

19 Claims, 11 Drawing Sheets

BLASTING MEDIA CONTAINMENT SYSTEM

FIELD OF THE INVENTION

This invention relates to a containment device in general and, more particularly, to a containment device for separating a desired surface or area from the remaining surroundings when applying a blasting media or other desired substance to the confined surface or area.

BACKGROUND OF THE INVENTION

It is known in the art to apply various substances and materials to a desired surface and to remove contaminants from a surface by use of blasting media. The blasting media may consist of a dry or liquid material or a combination thereof. Application of the blasting media generally results in a substantial quantity of media and contaminants becoming airborne which must be contained within a confined or treated area to prevent contamination to the surroundings. This is especially true if hazardous materials are to be removed from the desired surface.

Paint is often applied to surfaces via sprayers which can result in a significant quantity of overspray which becomes airborne and must be contained within the area to be treated to prevent contamination to the surrounding surfaces or equipment located adjacent the area being treated.

Containment systems currently known in the art are not easily assembled or constructed around obstructions such as lights, pipes, fixtures and other objects that are permanently secured in place to walls, ceilings and/or other surfaces.

SUMMARY OF THE INVENTION

Wherefore, it is an object of the present invention to overcome the aforementioned problems and drawbacks associated with the prior art designs.

Another object of the invention is to provide a containment device in close proximity to a work surface, e.g. a few inches to a few feet or so, while allowing a user to be located completely outside the containment area so that the user is not directly exposed to the blasting media, the substance being applied and/or contaminants or debris carried by the surface being treated.

Yet another object of the invention is to provide a containment system that can be readily erected around pipes, lights, fixtures, equipment, obstacles, etc.

Still another object of the invention is to completely seal the area to be treated so as to prevent any media, substance, material, contaminant, debris, etc., from escaping the containment area.

A further object of the invention is to prevent the escape of a substance contaminants and/or media from the containment area by generating and maintaining a negative air pressure within the area being treated, i.e. the containment area.

Yet another object of the invention is to minimize the size of the containment area so as to minimize the negative air requirements and the power requirements of the containment system.

In particular, the present invention relates to a containment system for defining and enclosing a surface to be treated, located within an area, said containment system comprising a flexible barrier being spaced a desired distance from said surface; an elongate flexible member being disposed between said barrier and said surface, said elongate flexible member sealingly defining a perimeter of said area; and an access port being provided in said barrier for facilitating application of a desired material into said area.

The present invention also relates to a method of defining and enclosing, via a containment system, a surface to be treated, located within an area, said method comprising the steps of: spacing a flexible barrier a desired distance from said surface; disposing an elongate flexible member between said barrier and said surface, and sealingly defining with said elongate flexible member a perimeter of the area; and providing an access port in said barrier for facilitating application of a desired material onto said surface located within said area.

BRIEF DESCRIPTION OF THE DRAWINGS

The invention will now be described, by way of example, with reference to the accompanying drawings in which.

DESCRIPTION OF THE PREFERRED EMBODIMENTS

The term "outwardly facing surface", as used within this patent application, means a surface of the grid which is remote from the surface to be treated while the term "inwardly facing surface" means the surface that is directly adjacent and facing the surface to be treated.

Figure 1:
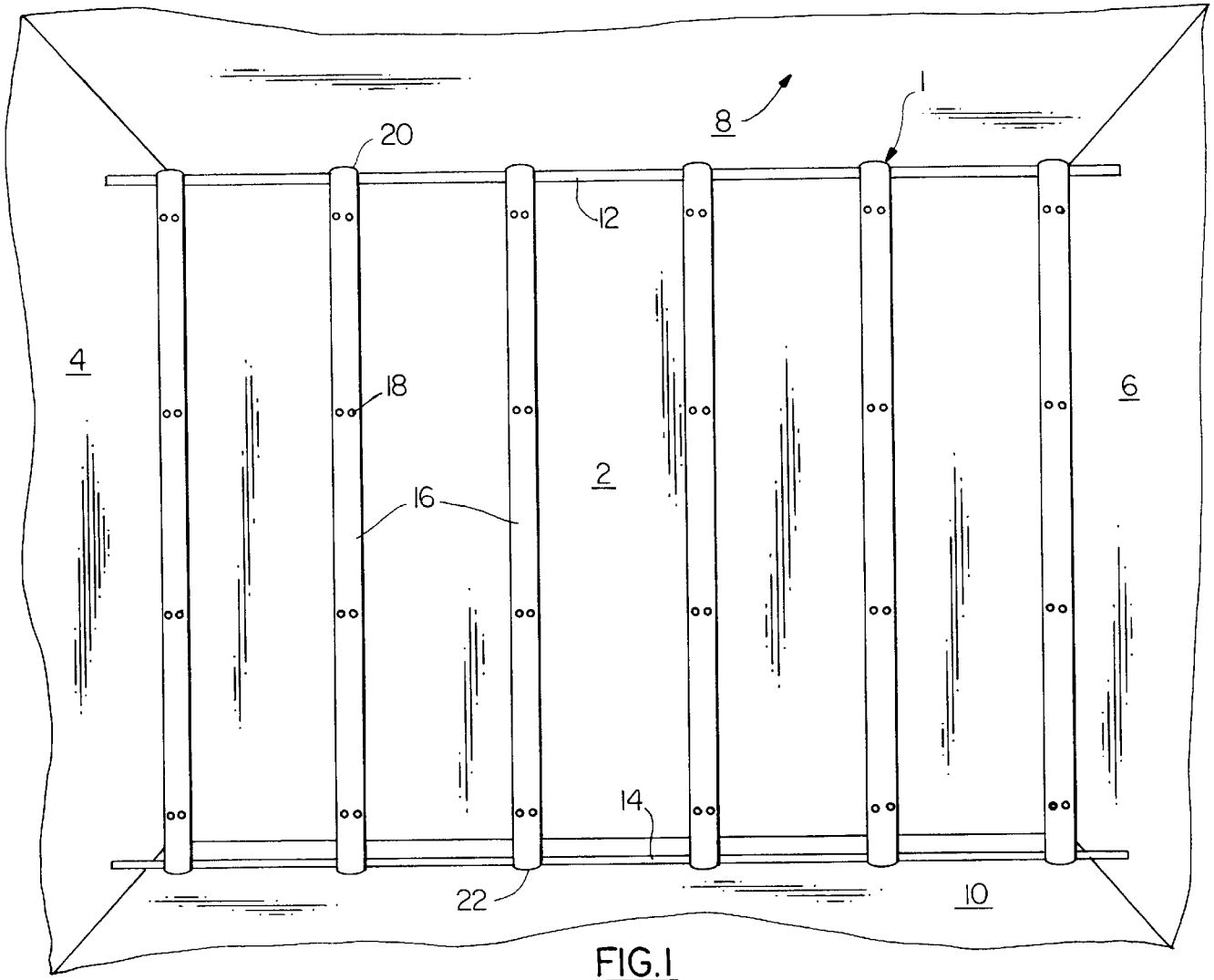
FIG. 1 is a diagrammatic elevational view of a partially constructed containment system according to the present invention.

Turning first to FIG. 1, a detailed description concerning the present invention will now be provided. A containment system, generally designated by reference numeral 1, is used to treat wall 2 which is connected to two side walls 4 and 6, ceiling 8, and floor 10. A first end of a first elongate rope, wire, chain, support or cable 12 is connected at one end thereof to side wall 4, via a suitable fastener or the like (not numbered) and the second opposed end of the first cable 12 is secured to side wall 6, via a suitable fastener or the like (not numbered). First cable 12 is located proximate ceiling 8 and spaced a desired distance from and extends substantially parallel to wall 2, e.g. a few inches to a few feet or so. A first end of a second elongate rope, wire, chain, support or cable 14 is connected at one end thereof to side wall 4, via a suitable fastener or the like (not numbered) and the second opposed end of the second cable 14 is secured to side wall 6, via a suitable fastener or the like (not numbered). Second cable 14 is located proximate floor 10 and spaced a desired distance from and extends substantially parallel to wall 2, e.g. a few inches to a few feet or so. It is to be appreciated that the suitable fastener, for the cables 12, 14, may include a tightening mechanism to insure that the cables 12, 14 are stretched tight between the two suitable fasteners. As such tightening mechanisms are well known to those skilled in this art, a further detail description concerning the same is not provided herein.

A plurality of vertical straps 16 extend between first and second cables 12 and 14. A first end 20 of each vertical strap 16 is wrapped around first cable 12 and secured to itself via mating fasteners 18 carried by the inwardly facing surface of each first end 20. A second end 22 of each vertical strap 16 is wrapped around second cable 14 and secured to itself via mating fasteners 18 carried by the inwardly facing surface of each second end 22. Adjacent vertical straps 16 are spaced from one another a desired distance, e.g. about 2–4 feet or so. First fasteners 18, e.g., touch fastener, snaps, buttons, zippers, etc., are provided at desired intervals along the length of vertical straps 16, preferably on an inwardly facing surface thereof, to facilitate attachment of other components thereto. It is to be appreciated that a variety of other attachment devices or members may be employed to secure vertical strap 16 to first and second cables 12 and 14 as well as facilitating attachment of other components to vertical straps 16. As such attachment devices or members are well known to those skilled in this art, a further detailed description concerning the same is not provided herein.

Figure 2:
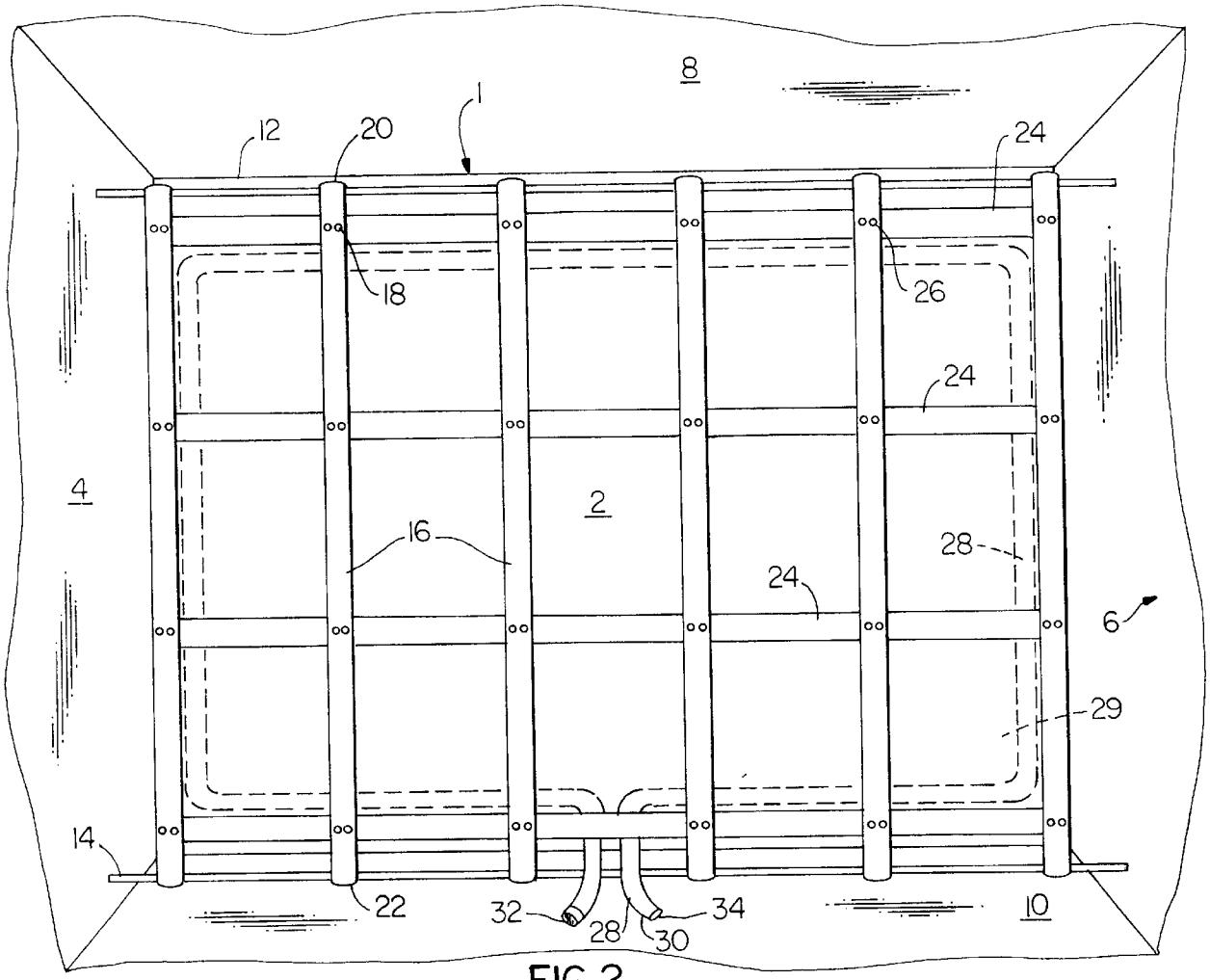
FIG. 2 is a diagrammatic elevational view of the containment system according to FIG. 1 with additional components being attached to the containment system.

As can be seen in FIG. 2, horizontal straps 24 are next secured to vertical straps 16 proximate ceiling 8 and floor 10 and at desired intervals therebetween, e.g. about 2–4 feet or so. Horizontal straps 24 extend from a first vertical strap 16, which is located proximate side wall 4, to a second vertical strap 16 which is located proximate side wall 6. Second fasteners 26 are provided at desired intervals along horizontal straps 24, preferably on an outwardly facing surface thereof, so that second fasteners 26 are located to cooperate with and attach to first fasteners 18 carried by vertical straps 16. Vertical straps 16 and horizontal straps 24 are preferably made from a flexible yet strong material such as nylon, rayon, or another similar material having similar properties and/or characteristics.

It is to be appreciated that first and second fasteners 18 and 26 may be any type of fastener which securely fastens vertical straps 16 to horizontal straps 24, such as hook and loop fasteners. First and second fasteners 18 and 26 may be disposed along the entire length of vertical straps 16 and horizontal straps 24, or only at desired intervals therealong.

In a preferred form of vertical strap 16, an end portion of each vertical strap 16 has a first touch fastener secured to an inwardly facing surface thereof. A second touch fastener, matable with the first touch fastener, is located and extends between the entire intermediate length, between the two first touch fasteners secured to the inwardly facing surface, to facilitate attachment of the first touch fastener with the second touch fastener once the vertical strap 16 is wrapped around first and second cables 12, 14. Each horizontal strap 24 preferably has a second touch fastener, secured to an inwardly facing surface thereof, extending along the entire length of the horizontal straps 24 to facilitate attachment of the other components thereto. The opposite outwardly facing surface of each horizontal strap 24 carries a first mating touch fastener to facilitate attachment of an outwardly facing surface of the horizontal strap 24 to the inwardly facing surface of the vertical strap 16.

Vertical straps 16 and horizontal straps 24, when attached to one another as shown in FIG. 2, form a grid 27 that extends parallel to but is spaced a desired distance from wall or surface 2 which is to be treated. A plurality of panels 42 are then secured to an inwardly facing surface of grid 27 and further detailed discussion concerning the same will follow below.

Hose 28 is disposed between wall 2 and grid 27 about the perimeter of the desired surface to be treated. A containment area 29 is defined as the space located between grid 27 and panels 42 supported thereby, wall 2 and hose 28. Grid 27 is spaced relatively close to wall 2 in order to minimize the volume of containment area 29, but is spaced far enough away to provide access between wall 2 and grid 27 to facilitate treatment of the wall 2.

A first end 30 of hose 28 has fitting 34, which facilitates attachment of that end to an air source 35 (see FIG. 6), while second end 32 of hose 28 is closed off or sealed to prevent the escape of pressurized air from hose 28. Hose 28 is made of a flexible material which will allows hose 28 to expand as it fills with air to seal against wall 2 and grid 27. This feature enables hose 28 to conform to the shape of any object against which it abuts during inflation and thereby provide a secure and preferably air-tight seal substantially around the entire perimeter of the surface or area to be treated. Hose 28 is positioned about the perimeter of the desired surface to be treated and located between wall 2 and grid 27. Hose 28 is preferably disposed within containment area 29 substantially parallel to and proximate side walls 4 and 6, ceiling 8, and floor 10, thus defining the perimeter of containment area 29. It is to be appreciated that the arrangement of hose 28 may vary depending upon the application at hand.

Hose 28 may also be formed from a resilient material, e.g. a closed cell foam, which is elongate and has a substantially constant width along its entire length. According to this embodiment, hose 28 is merely compressed or squeezed into position, between the wall 2 and grid 27, to define the desired containment area perimeter. Due to the natural resiliency of the hose 28, it expands to its original position, when no longer compressed, so as to form an air-tight seal substantially around the perimeter of the surface to be treated, including any objects against which hose 28 may abut while expanding to its original position.

Hose 28 may be positioned such the portion that is proximate floor 10 slopes downward from side walls 4 and 6 toward the center of grid 27 substantially in a V shaped configuration. This sloping effect will direct solids and any fluid which accumulate in confinement area 29 to a central area where it can be collected.

Figure 3:
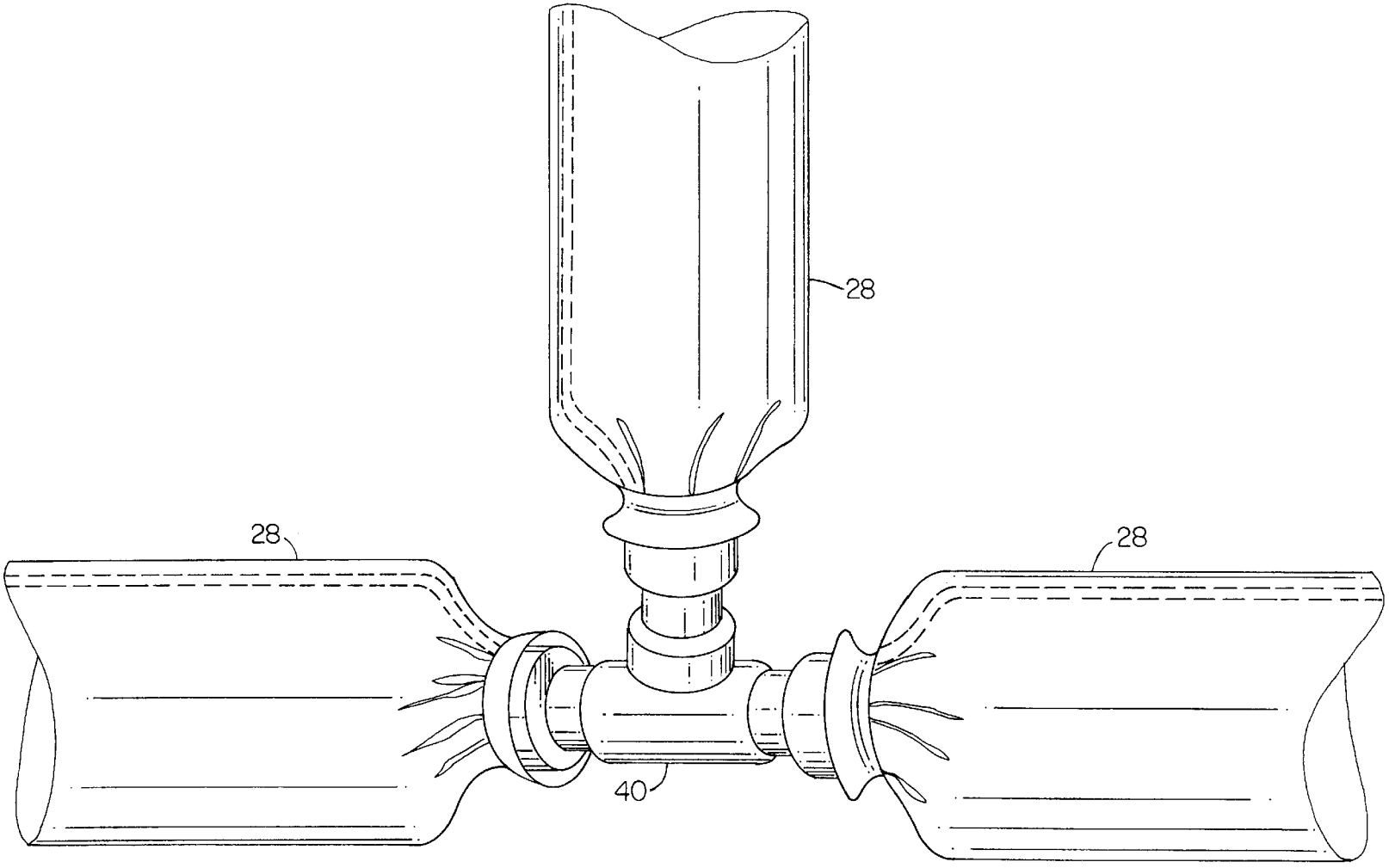
FIG. 3 is a diagrammatic perspective view of a hose according to the present invention.

Hose 28 need not be a single hose, but can be comprised of a plurality of hoses 28 which are attached to one another by tee connections 40, as can be seen in FIG. 3, to partition containment area 29 into a plurality of individual compartments. In FIG. 3, hose 28 is shown in a deflated state in which the tee connection 40 is exposed. When hose 28 is inflated, an exterior surface of hose 28 expands radially and axially toward one another and completely seal the tee connection 40 so that no air will leak passed the tee connection when hose 28 is positioned and inflated between surface 2 and grid 27.

Figure 4:
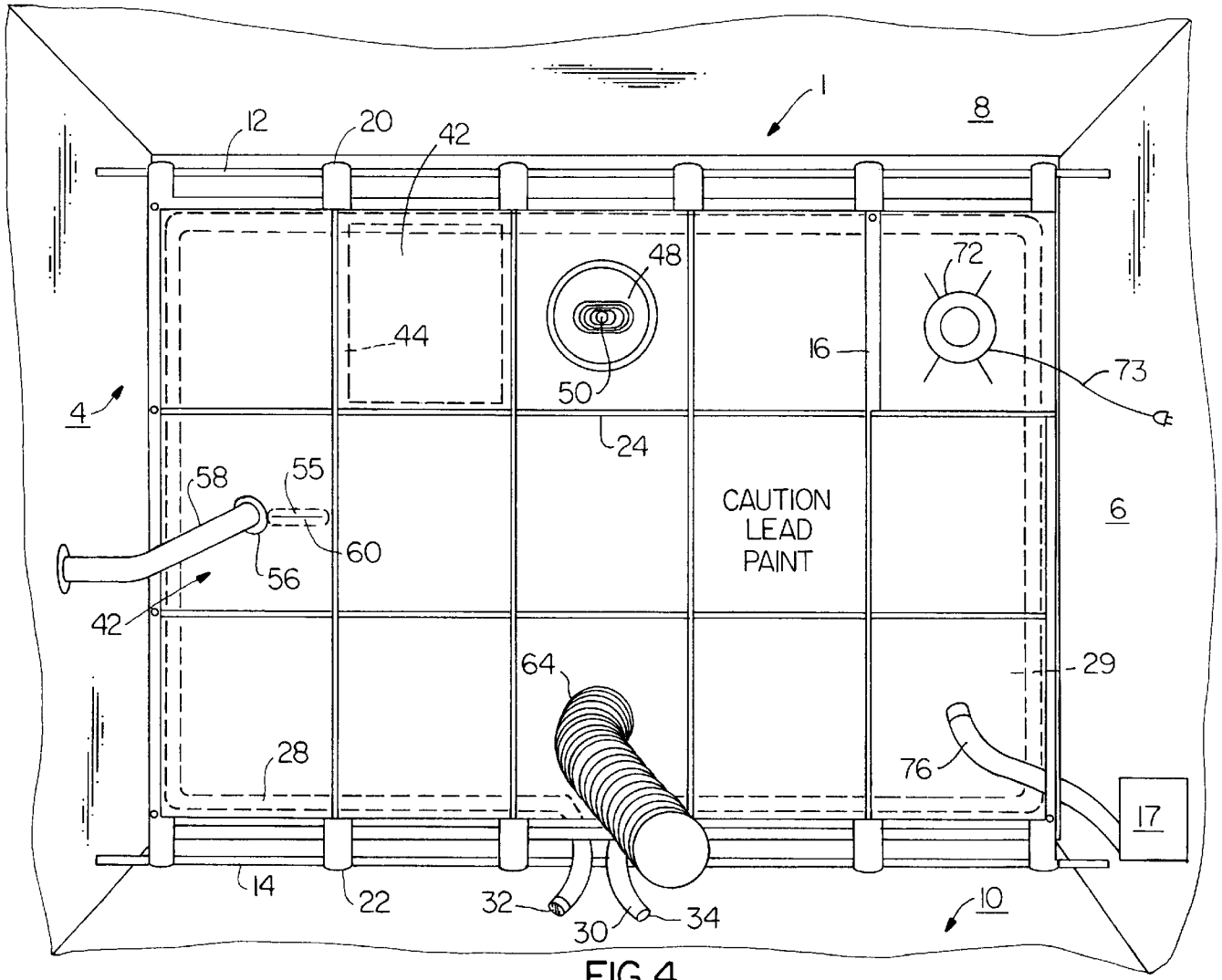
FIG. 4 is a diagrammatic elevational view of a completed first/embodiment of the containment system of the present invention.

Turning now to FIG. 4, a plurality of panels 42 are shown secured to grid 27. Panels 42 are sized to cover the areas defined by adjacent pairs of vertical straps 16 and horizontal straps 24. Panels have, along their outwardly facing surface along the perimeter edge, a mating fastener 44. Fastener 44 is typically one of a hook or a loop fastener. Fasteners 18, 26 which are disposed along at least a portion of vertical straps 16 and horizontal straps 24 mate with fastener 44. As panels 42 are attached to grid 27, fasteners 44 mate with fasteners 18, 26 thereby securing panels 42 to grid 27 at a desired location.

Panels 42 are made of a material which is flexible, yet strong enough to withstand the negative pressure to be generated within the containment area 29 during application of a media and/or substance, material or the removal of contaminants and debris, e.g. a negative pressure of about a few pounds per square inch or so. Panels 42 may be made of coated nylon, for example.

Panels 42 may also be designed to provide sound insulation, since the application of a media and/or a substance, material or the removal of contaminants and debris may generate significant noise. To minimize the noise generated in the surrounding environment, panels 42 may comprise a waterproof laminate disposed over a desired thickness of sound insulating material, e.g. fiberglass. The waterproof laminate preferably faces the containment area 29 and the sound insulating material preferably faces the surrounding environment.

One of the panels 42 is provided with access port member 48 having an elongate slot 49 therein. Fitting 50 is accommodated within elongate slot 49 and sealed with respect to the slot by a rubber boot, or some other similar sealing component, to provide an air tight seal therebetween. An applicator for applying media, such as a hose or nozzle (not shown), extends through fitting 50 to provide the desired surface treatment. Access port member 48 is typically a flexible conical shaped member or a planar circular shaped member which is rotatable 360° relative to the remaining portion of panel 42 via a perimeter bearing, or the like. Elongate slot 49 extends from an outer periphery of the member to a central area thereof and this allows the applicator a range of motion of at least about 90° to facilitate the desired application within containment area 29 so that the entire surface or wall 2 can be treated. During application of media to the surface or wall 2, panels 42 prevent any media which may rebound off of wall 2 from escaping the containment area 29 and thereby provides a complete barrier between the containment area 29 and the surrounding environment.

Figure 5:
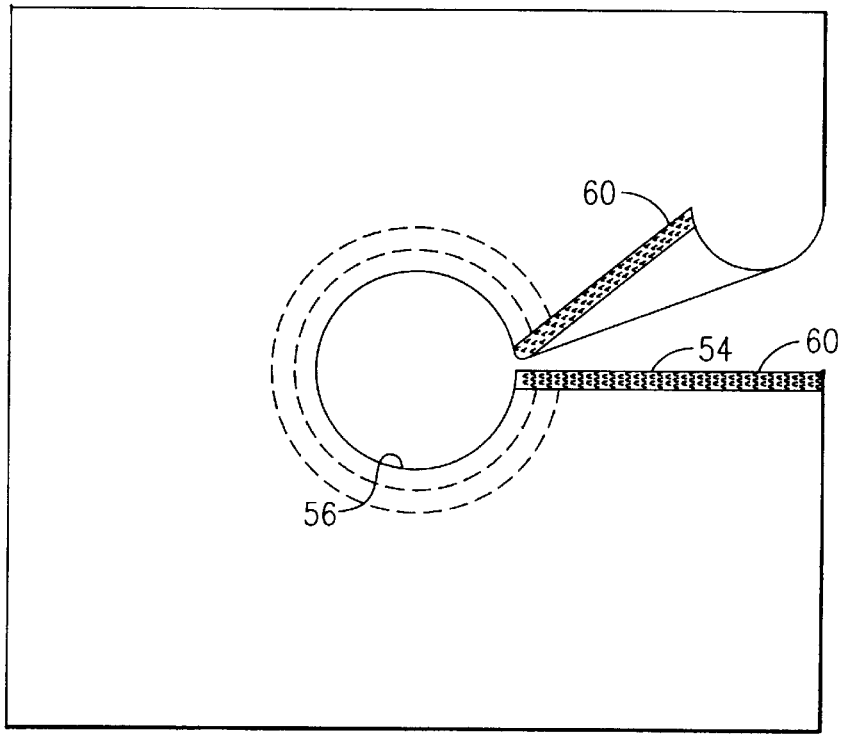
FIG. 5 is a diagrammatic perspective view of a variation of a panel of the containment system to FIG. 4.

In one variation of panels 42, a slit 54 may be provided, as shown in FIGS. 4 and 5, which extends from an outer edge of panel 42 to a centrally located aperture 56. When installing such a panel 42, slit 54 is spread apart or expanded, panel 42 is passed over the obstruction, pipe 58, which extends through grid 27, and panel 42 thus surrounds and seals pipe 58. Panel 42 is then secured to grid 27 by mating fasteners 60, which are disposed along opposed overlapped edges of slit 54 and are secured to one another in order to seal slit 54. Mating fasteners 60 may be hook and loop fasteners, with mating portions being disposed along the opposed overlapped edges of slit 54. The size and location of aperture 56 may be varied, depending upon the application, so that such panel may be used to provide a seal around any obstruction which protrudes through grid 27.

Exhaust hose 64 is secured, at one end thereof, to a panel 42 as shown in FIG. 4. Exhaust hose 64 is connected at its other end to a vacuum pump or other suction means 65 (see FIG. 6), such as a Dust Collector manufactured by IPEC Inc. of Rhode Island, U.S.A. The exhaust hose 64 and the suction means 65 create a negative pressure within containment area 29, during use of the system, to remove airborne media, excess applied substance, material, contaminants, debris, etc. from containment area 29. This negative pressure reduces the opportunity for media and/or contaminants to escape from containment area 29 into the surrounding area other than via exhaust hose 64.

A desired warning message 68 may be printed on or otherwise provided on one of the panels 42. Warning message 68 is imprinted on an outwardly facing surface of one panel 42 to alert individuals to any potential hazards present, such as "CAUTION—LEAD PAINT", "CAUTION—LOW LEVEL RADIATION", or some other toxic material. Warning message 68 may be directly printed on a rear surface of panel 42 via ink, paint or any other suitable means, or may be provided by other methods such as braille characters.

Light source 72 may be secured to an inwardly facing surface of one panel 42, such that light source 72 projects into containment area 29 to provide illumination of the entire containment area 29. One end of electrical cord 73 extends through panel 42 and is connected to light source 72 while the opposite end of electrical cord 73 is connected to a power source (not shown) . Alternatively, light source 72 may be attached to an outwardly facing surface and project light through a hole provided in panel 42 to facilitate directing the light source 72 at any desired area of the of the surface to be treated.

Moisture supply hose 76 has a first end thereof secured to a coupling attached to an outwardly facing surface of panel 42 while the opposite end of moisture supply hose 76 is connected to a source of moisture 77, such as a misting device for providing moisture. The coupling communicates with an aperture provided in panel 42. Containment area 29 is saturated with moisture, during use, thereby reducing the amount of dry particles airborne within containment area 29.

Figure 6:
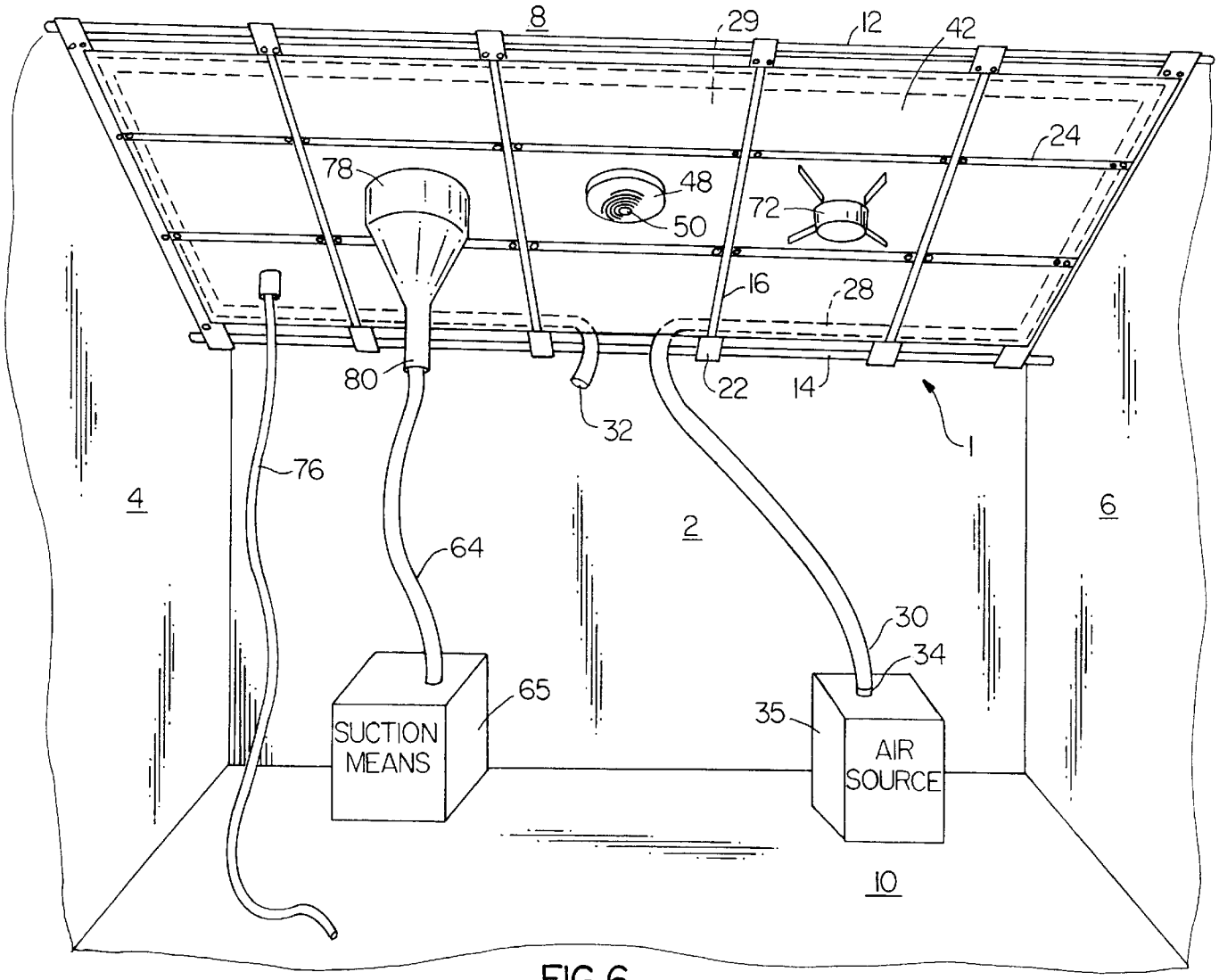
FIG. 6 is a diagrammatic perspective view of a completed second embodiment of the containment system of the present invention.

With reference to FIG. 6, a second embodiment of the present invention is shown and will now be discussed in detail. This embodiment of the containment system 1 is similar to that of the first embodiment, except that the surface to be treated is overhead, ceiling 8. Grid 27, therefore, is formed in the same manner as with the first embodiment but parallel to ceiling 8 rather than wall 2. For the sake of simplicity, a further detail discussion of grid 27 is not provided.

According to this embodiment, a funnel 78 is secured to one panel 42, provided with a central aperture therein, such that the apex 80 of funnel 78 extends away from panel 42 toward the surrounding environment. Funnel 78 communicates with the confinement area 29, via the central aperture, and a first end of exhaust hose 64 is attached to apex 80 and an opposite end thereof to suction means 65. As media is injected into containment area 29, the shape of funnel 78 facilitates the collection and removal of the media and/or contaminants from containment area 29 through exhaust hose 64. In this embodiment it may be desirable, in some applications, to allow the horizontal and vertical straps to sag somewhat to facilitate channeling of the media, contaminants and/or debris toward the funnel 78 to facilitate collection thereof.

Figure 7:
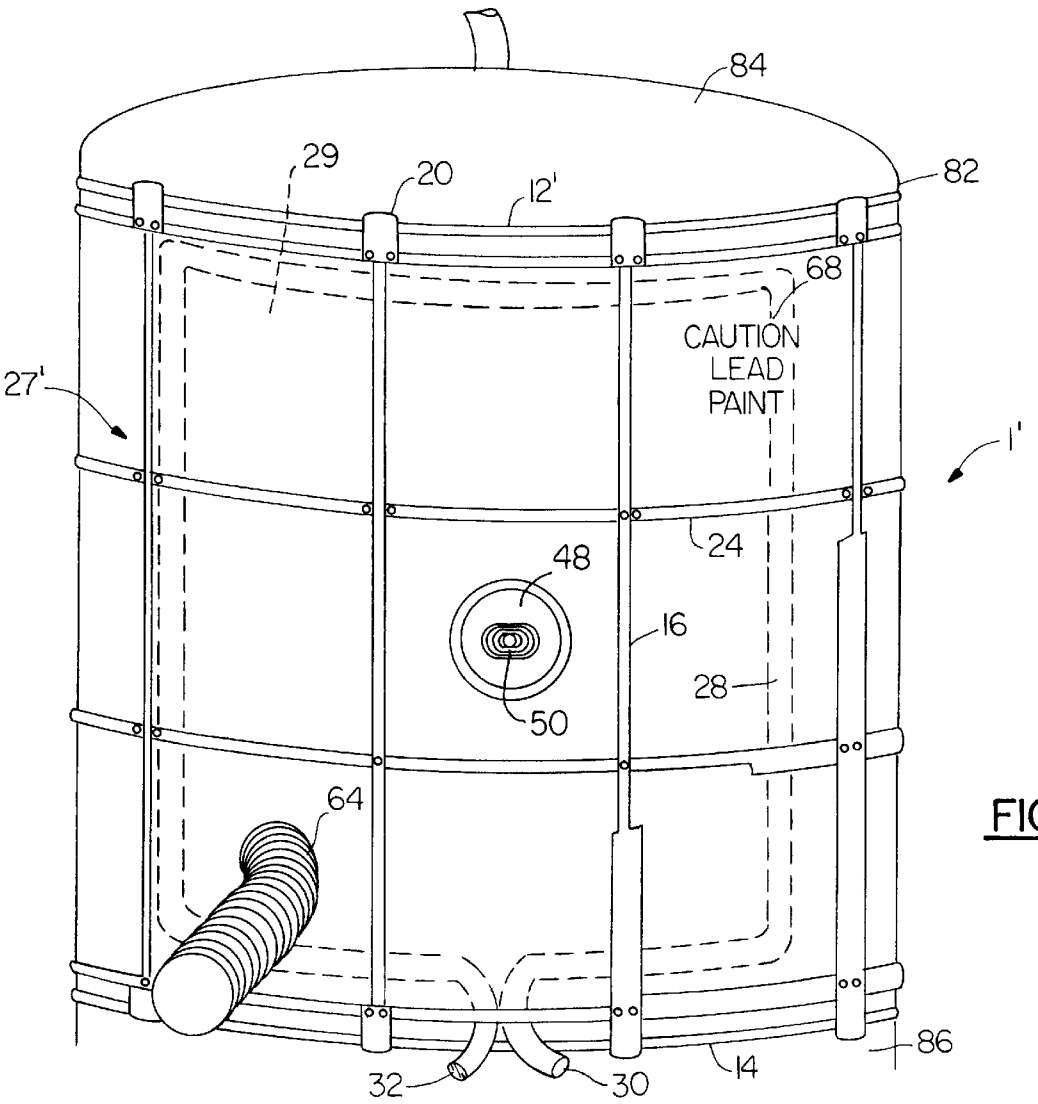
FIG. 7 is a diagrammatic perspective view of a completed third embodiment of the containment system of the present invention.

With reference to FIG. 7, a third embodiment of the present invention is shown and will now be discussed.

Containment system 1', according to this embodiment, is constructed around a portion of a cylindrical tank 82. Cable 12' is secured adjacent an upper surface 84 thereof, but spaced from tank 82. A plurality of spacers may be utilized to space cable 12' a desired distance, a few inches to a few feet or so, away from an exterior surface of tank 82. Cable 14' is likewise secured adjacent a lower surface 86 thereof, but spaced from tank 82 by a plurality of spacers. Containment area 29' is thus defined by grid 27' comprised of vertical straps 16 extending between cables 12' and 14' and horizontal straps 24 interconnecting vertical straps 16. Grid 27' is covered with panels 42 and hose 28 is installed to surround the perimeter of the desired area in the same manner as the first embodiment shown in FIG. 4, In this embodiment, containment area 29' is typically disposed along only a desired partial cylindrical portion of the outer circumference of tank 82.

After the desired portion of the exterior surface of tank 82 defined by the containment area 29' is treated, the containment system 1' is moved to an adjacent portion of tank 82 for subsequent treatment, and this process is repeated until all of the desired areas of tank 82 have been effectively treated.

Figure 8:
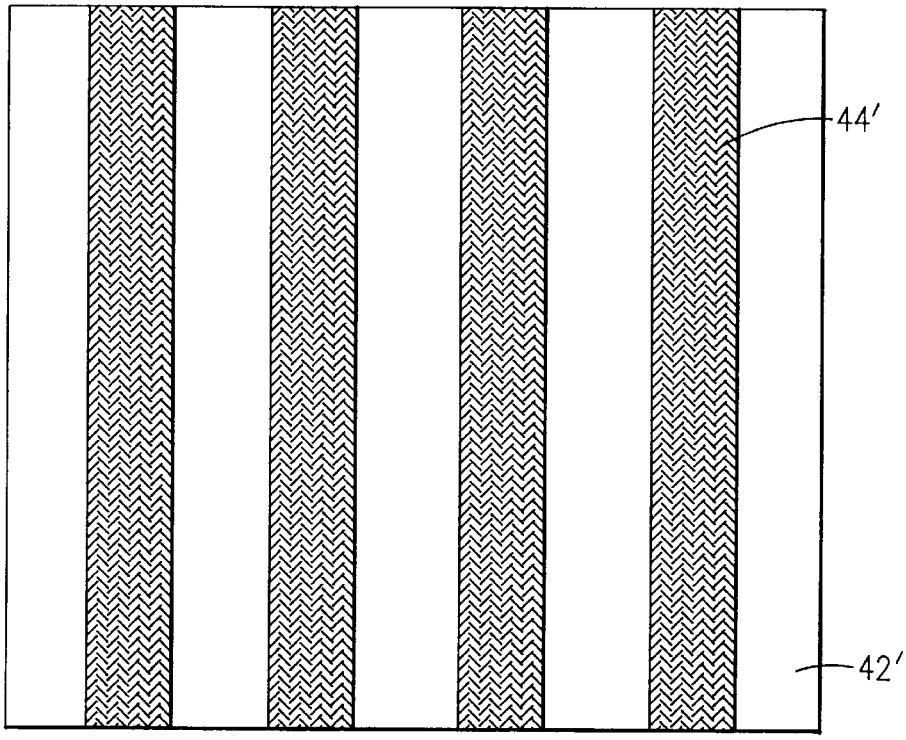
FIG. 8 is a diagrammatic elevational view of a further variation of a panel of the present invention.

In accordance with another aspect of the present invention, panels 42' of FIG. 8 may be utilized. Panels 42' have a plurality of elongate strips of fasteners 44' secured to a first surface thereof, i.e. either the outwardly facing surface or the inwardly facing surface of the panel. Panels 42' are of varying size and shape which facilitate securing panels 42' to grid 27 around objects or obstructions such as heating duct 88 or the like.

Figure 9:
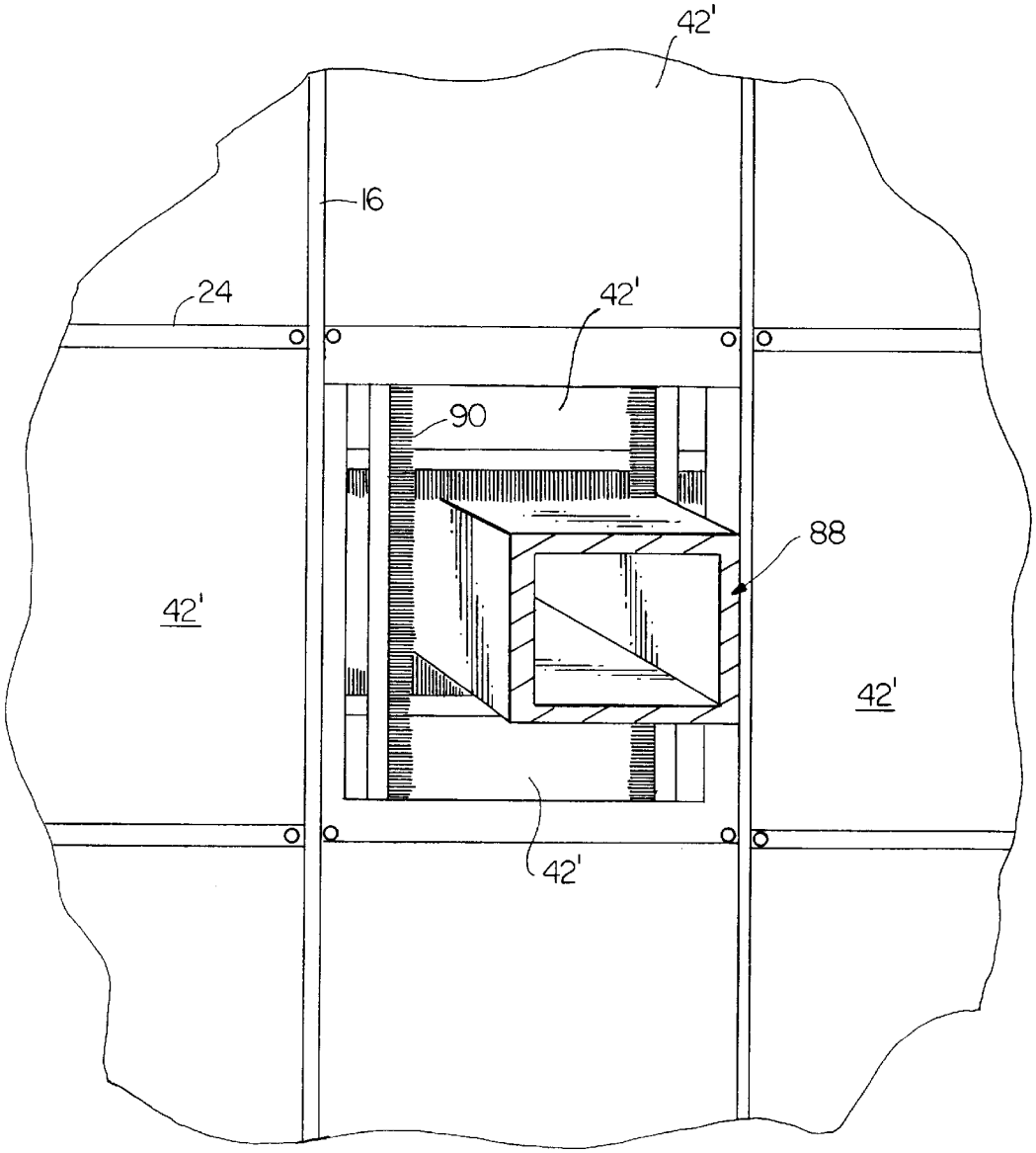
FIG. 9 is a diagrammatic perspective view of the still further variation of a panel according to the present invention.

With reference to FIG. 9, heating duct 88, which has a rectangular cross section, projects through grid 27 away from containment area 29. Panels 42' are secured to vertical straps 16 and horizontal straps 24 in an overlapping manner so as to fully surround heating duct 88. Fasteners 44' on panels 42' attach to corresponding fasteners 44' on other panels 42' as well as to fasteners 18, 26 on vertical straps 16 and horizontal straps 24. Panels 42' may also have brushes 90 secured to edges thereto to provide a complete seal around heating duct 88.

Figure 10:
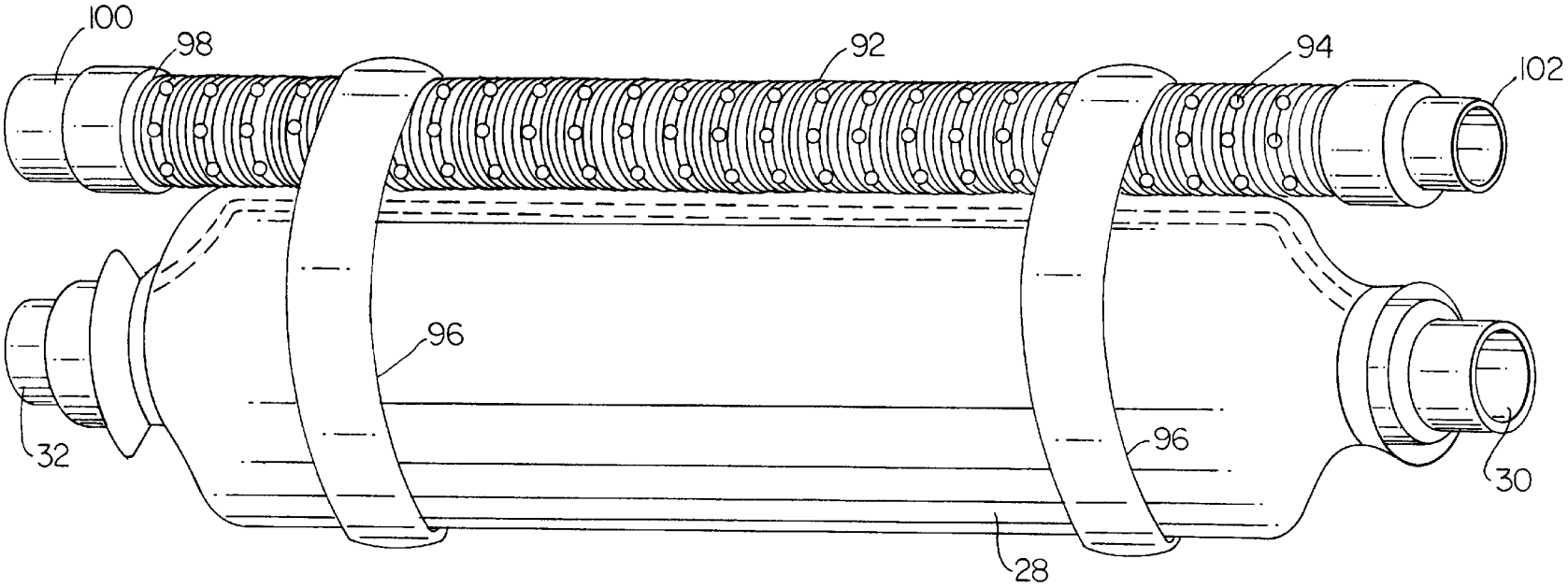
FIG. 10 is a diagrammatic perspective view of a vacuum hose according to the present invention.

As shown in FIG. 10, vacuum hose 92 may be provided in combination with hose 28. Vacuum hose 92 is disposed adjacent and secured to hose 28, via a strap 96, such that vacuum hose 92 is located inside containment area 29 during use. Vacuum hose 92 has a plurality of apertures 94, of a suitable size, disposed about its periphery and along its length. A first end of vacuum hose 92 is closed by cap 100, and second opposed end 102 thereof is also connected to suction means 65.

When suction means 65 is actuated, any accumulated media, substance, material, liquid, contaminants and/or debris are removed from containment area 29 via vacuum hose 92 and conveyed to suction means 65 where the media, substance, material, liquid, contaminants and/or debris can be separated from one another and recycled or properly disposed.

Figure 11:
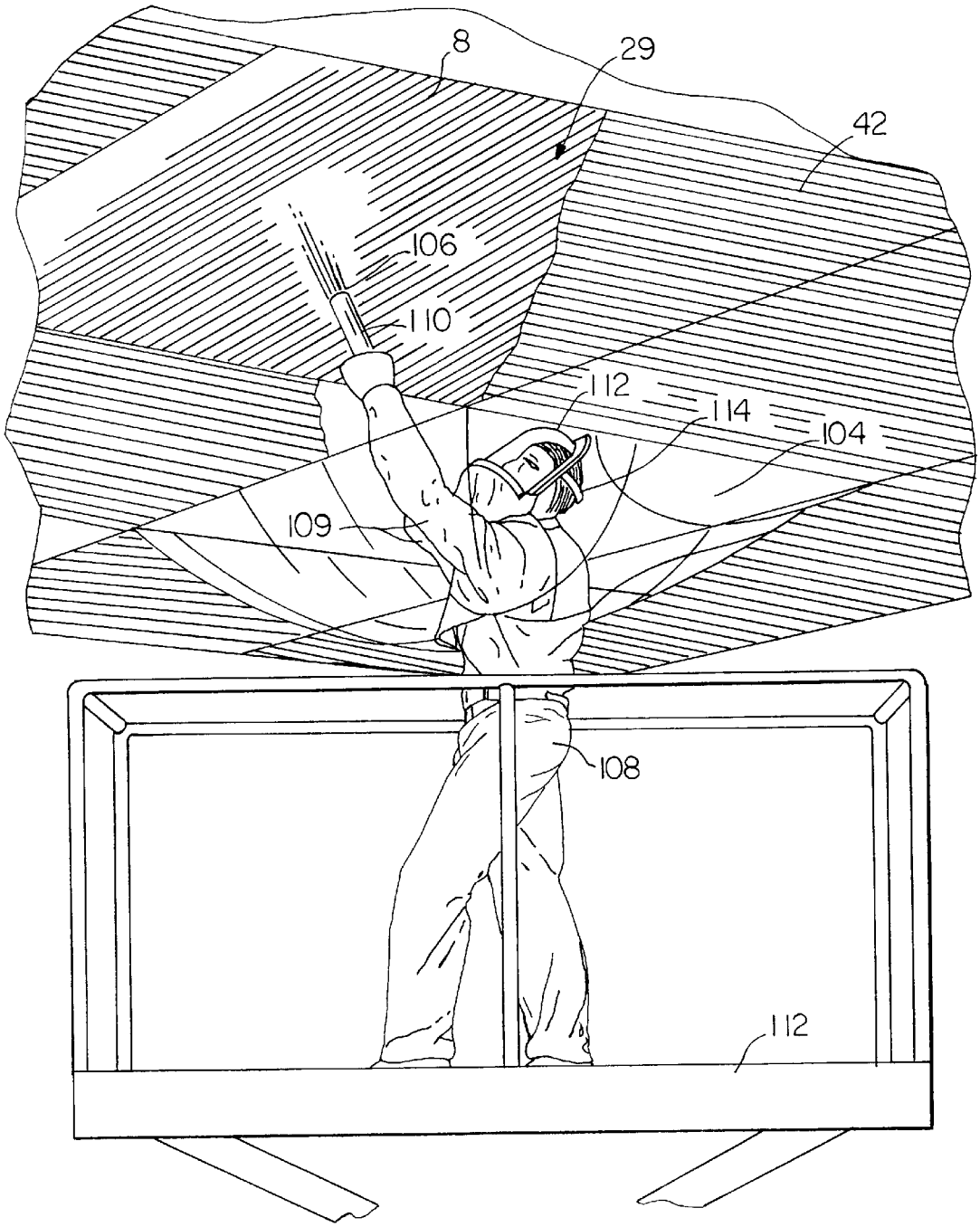
FIG. 11 is a diagrammatic perspective view of a second embodiment of an access panel for the containment system of the present invention.
Figure 12:
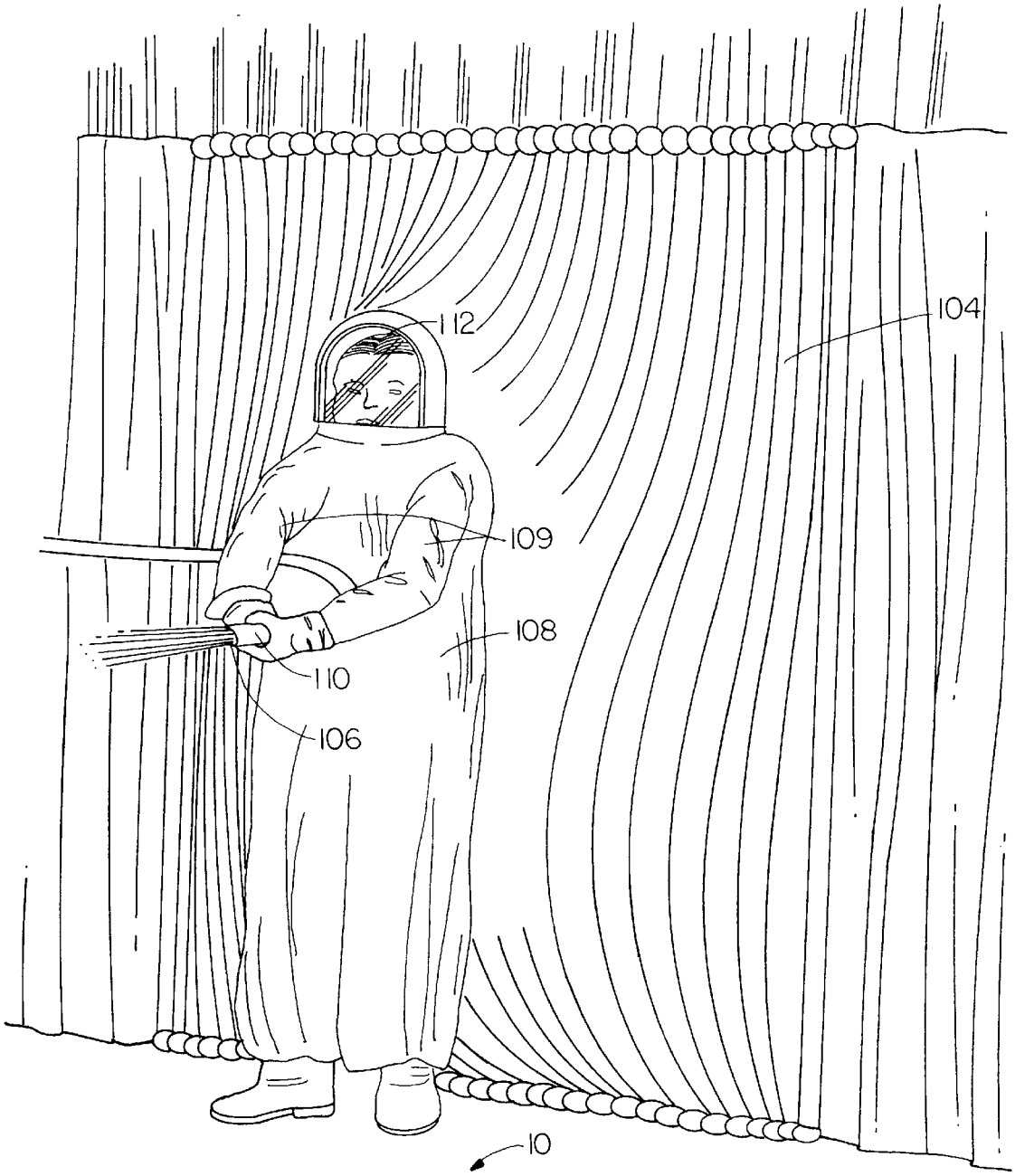
FIG. 12 is a diagrammatic perspective view of the third embodiment of an access panel for the containment system according to the present invention.

A few further embodiments of an access panel, according to the present invention, are shown in FIGS. 11 and 12. In FIG. 11, access panel 104 is attached to grid 27 in lieu of a panel 42. Access panel 104 is made of a clear flexible material with an inlet port 106 provided at a central location. A pair of elongate tubular cavities 109 are formed in the clear flexible material and sized to allow a user to pass his/her arms therethrough and manipulate inlet port 106 to facilitate control of the blasting or applying applicator. Access panel 104 may be made of a clear plastic material such as Lexon and typically has a thickness of about between two (2) and ten (10) mils. The entire outer perimeter of the clear flexible material is provided with a mating touch fastener for securing the access panel 104 to the adjacent horizontal and vertical straps.

A user 108 attaches or extends an applicator 110, a blasting nozzle or spray gun nozzle, into and through port 106 so that the end of applicator 110 communicates directly with the interior of containment area 29. Access panel 104 thus creates a flexible boundary between containment area 29 and the surrounding environment which allows a user 108 to remain completely outside containment area 29 while projecting at least a portion of their body into what was formerly defined as containment area 29 to facilitate accurate and precise application of the desired media or substance. User 108 thus can operate applicator 110 with access to and complete visibility of containment area 29 without being directly exposed to any of the contaminants or hazardous materials contained within containment area 29 or on the surface being treated.

A shield 112, having an attachment device 114, is provided for attaching to shield 112 to a head of the user 108. Shield 112 is preferably made from glass or plexiglas and has curved configuration. The user 108 secures the shield 112 to his/her head via attachment device 114 to facilitate viewing of surface 2 while operating applicator 110. For some applications, overhead, user 108 may stand on a platform 112, as can be seen in FIG. 11.

Access panel 104 may be sized so as to accommodate a substantial portion of an upper body of individual 108 within containment area 29. As can be seen in FIG. 12, access panel 104 is draped around user 108 as he/she steps into containment area 29. User 108 is thus fully and completely protected from the media, substance, material and/or contaminants within containment area 29, yet has full visibility and limited access to containment area 29.

It is to be appreciated that containment system 1 can be constructed to surround an object, such as a piece of equipment, so that it the entire exposed surfaces of the object may be treated during a single blasting application without being required to modify the location of the containment system 1.

Since certain changes may be made in the above described containment system, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I/we claim:

1. A containment system for defining and enclosing a surface to be treated, located within an area, said containment system comprising:

an air source for supplying pressurized air;

a flexible barrier being spaced a desired distance from said surface;

an elongate flexible member being disposed between said flexible barrier and said surface, said elongate flexible member defining a perimeter of said area and being coupled to said air source so that when said pressurized air is supplied to said elongate flexible member, said elongate flexible member expands to provide a seal between said barrier and said surface to facilitate containment of a material to be used within said area; and an access port being provided in said barrier for facilitating application of a desired material into said area.

2. A containment system according to claim 1, wherein said containment system further comprises suction means extending through said barrier for removing material from said areas.

3. A containment system according to claim 1, wherein said barrier further comprises:

a first elongate suspension member being secured substantially parallel to and proximate a first edge of said area;

a second elongate suspension member being secured substantially parallel to and proximate a second edge of said area, and said second edge being substantially parallel to said first edge;

a plurality of elongate vertical members being attached at a first end thereof to said first elongate suspension member and at a second end thereof to said second elongate suspension member;

a plurality of elongate horizontal members being attached to said plurality of vertical members thereby forming a grid; and a plurality of panels being attached to said grid.

4. A containment system according to claim 1, wherein said elongate flexible member is an inflatable hose for providing, in use, an air tight seal between said surface to be treated and said barrier.

5. A containment system according to claim 4, wherein said hose comprises:

a plurality of elongate sections of hose; and a plurality of connectors interconnecting said plurality of elongate sections of hose to one another.

6. A containment system according to claim 1, wherein said containment system further comprises moisture supply means coupled to an opening provided in said barrier, via a conduit, for supplying moisture into said area during use.

7. A containment system according to claim 1, wherein said containment system further comprises a panel supporting a light source for illuminating said area during use.

8. A containment system according to claim 1, wherein said containment system further comprises a panel which has an aperture provided therein, and said aperture is sized to accommodate a desired object protruding through said barrier; and a slit extends from an edge of said barrier to said aperture to facilitate securing said barrier around said object.

9. A containment system according to claim 2, wherein said containment system further comprises a panel provided with an aperture therein; and a funnel shaped member having a mouth is secured to said aperture and an apex is securable to said suction means.

10. A containment system according to claim 1, wherein at least a portion of said suction means is disposed within said area, during use, adjacent said elongate flexible member to facilitate removal of material from said area.

11. A containment system according to claim 9, wherein said suction means is a flexible hose which has a plurality of apertures therein along a length of the flexible hose.

12. A containment system according to claim 1, wherein at least a portion of said barrier is transparent to facilitate viewing of said area from outside said area.

13. A containment system according to claim 12, wherein said transparent portion is made of a clear flexible material, an inlet port is provided in said clear flexible material to facilitate application of a desired material to said surface to be treated, a cavity is provided to accommodate a head of a user, and a pair of tubular cavities are formed in said clear flexible material and sized to allow an operator's arms to extend therein for manipulating and controlling said inlet port.

14. A kit for defining and enclosing a surface to be treated, located within an area, comprising:

a first elongate suspension member being secured substantially parallel to and proximate a first edge of said area suction means extending through said barrier for removing material from said area.

15. A kit as claimed in claim 14, further comprising moisture supply means coupled to an opening provided in said barrier, via a conduit, for supplying moisture to said area during use.

16. A kit as claimed in claim 14, further comprising a panel supporting a light source for illuminating said area during use.

17. A kit as claimed in claim 14, further comprising a panel which has an aperture provided therein, said aperture being sized to accommodate a desired object protruding through said barrier; and a slit extending from an edge of said barrier to said aperture to facilitate securing said barrier around said object.

18. A method of defining and enclosing, via a containment system, a surface to be treated, located within an area, said method comprising the steps of:

spacing a flexible barrier a desired distance from said surface;

disposing an elongate flexible member between said barrier and said surface, and defining with said elongate flexible member a perimeter of the area and coupling said air source to said elongate flexible member;

supplying pressurized air, via said air source, to said elongate flexible member to expand said elongate flexible member and provide a seal between said barrier and said surface to be treated to facilitate containment of a material to be used within said area; and providing an access port in said barrier for facilitating application of a desired material onto said surface located within said area.

19. A method according to claim 18, wherein said method further comprises the step of extending suction means out through said barrier for removing material from said area.

* * * * *